US010794324B2

(12) United States Patent
Mori et al.

(10) Patent No.: US 10,794,324 B2
(45) Date of Patent: Oct. 6, 2020

(54) SPACER

(71) Applicant: UCHIYAMA MANUFACTURING CORP., Okayama (JP)

(72) Inventors: Masayuki Mori, Okayama (JP); Koji Makino, Okayama (JP)

(73) Assignee: UCHIYAMA MANUFACTURING CORP., Okayama (JP)

( * ) Notice: Subject to any disclaimer, the term of this patent is extended or adjusted under 35 U.S.C. 154(b) by 655 days.

(21) Appl. No.: 14/917,179

(22) PCT Filed: Sep. 4, 2014

(86) PCT No.: PCT/JP2014/073307
§ 371 (c)(1),
(2) Date: Mar. 7, 2016

(87) PCT Pub. No.: WO2015/037506
PCT Pub. Date: Mar. 19, 2015

(65) Prior Publication Data

US 2016/0195036 A1 Jul. 7, 2016

(30) Foreign Application Priority Data

Sep. 11, 2013 (JP) ..... 2013-188374

(51) Int. Cl.
*F02F 1/14* (2006.01)
*F02F 1/10* (2006.01)

(52) U.S. Cl.
CPC ..... *F02F 1/14* (2013.01); *F02F 1/10* (2013.01); *F02F 1/108* (2013.01)

(58) Field of Classification Search
CPC ..... F02F 1/14; F02F 1/10; F02F 1/108
(Continued)

(56) References Cited

U.S. PATENT DOCUMENTS 7,398,596 B2 7/2008 Takashi
2005/0120653 A1* 6/2005 Okazaki ..... B29C 37/005 52/302.1

(Continued)

FOREIGN PATENT DOCUMENTS

JP 2005105878 A2 4/2005
JP 2012-007478 1/2012
JP 2012036742 A2 2/2012

OTHER PUBLICATIONS

International Search Report dated Oct. 21, 2014 filed in PCT/JP2014/073307.

(Continued)

*Primary Examiner* — Lindsay M Low
*Assistant Examiner* — Omar Morales
(74) *Attorney, Agent, or Firm* — Rankin, Hill & Clark LLP

(57) ABSTRACT

Provided is a spacer configured such that a protruding portion remaining after removal of a portion unnecessary after molding does not contact an inner wall of a coolant water flow path and therefore, even a portion of the spacer in the vicinity of the remaining portion can be positioned close to the cylinder bore side inner wall. The spacer of this embodiment is a spacer (4) formed of a resin molded body and inserted, in use, into a coolant water flow path (3) through an opening (30) of the coolant water flow path (3) that is formed around a plurality of cylinder bores (2) formed adjacent to each other in a cylinder block (1) of an internal combustion engine. The spacer (4) includes a spacer body (40) formed in a cylindrical shape to surround the cylinder bores (2), and a protruding remaining portion (5) remaining after removal of a portion (**6*ba*) necessary in molding and unnecessary after molding. The remaining portion (5**) is
(Continued)

formed at an end surface (44*a*) positioned on a side close to the opening (30) of the spacer body (40).

15 Claims, 10 Drawing Sheets

(58) Field of Classification Search
USPC ..... 123/41.79
See application file for complete search history.

(56) References Cited

U.S. PATENT DOCUMENTS

| | | | | |
|---|---|---|---|---|
| 2011/0114041 | A1* | 5/2011 | Hamakawa | F02F 1/14 123/41.72 |
| 2012/0132157 | A1* | 5/2012 | Matsuki | F02F 1/14 123/41.79 |

OTHER PUBLICATIONS

Japanese Decision to Grant dated Jun. 27, 2017 for the corresponding Japanese Patent Application No. 2013-188374.

* cited by examiner

SPACER

TECHNICAL FIELD

The present invention relates to a spacer formed of a resin molded body. The spacer is used by being inserted into a coolant water flow path (a water jacket) formed around a plurality of cylinder bores formed adjacent to each other in a cylinder block of an internal combustion engine.

BACKGROUND ART

A spacer configured to adjust the flow (e.g., the flow rate or the flow velocity) of circulating coolant water is inserted into a water jacket of an internal combustion engine as described above. In the case where cylinder bores are continuously formed in series, the planar shape of the water jacket is an elongated circular shape substantially along the outer shape of the entirety of the cylinder bores. Thus, the water jacket is in such a shape that a narrow portion is formed at a position corresponding to a coupling portion between adjacent ones of the cylinder bores. The spacer fits such a shape of the water jacket. The spacer is in a cylindrical shape surrounding the periphery of the cylinder bores. Typically, such a spacer is integrally molded by resin injection molding. The spacer is formed by injection molding under high temperature. The shape of the spacer is retained in such a manner that the spacer is gradually cooled down to normal temperature after detachment from a mold. In gradual cooling, the spacer tends to deform due to heat contraction imbalance because of the elongated circular cylindrical shape of the spacer. Patent Literature 1 describes the following manufacturing method for preventing the above-described deformation. In molding, a bridge portion (a crossing portion) coupling between opposing surfaces of the spacer is first integrally molded. Then, shape retention is performed by gradual cooling after detachment of the spacer from the mold, and then, such a bridge portion is removed. Patent Literature 1 discloses the example where a runner for injecting molten resin into a cavity through a gate is used as the bridge portion.

Moreover, Patent Literature 2 describes a spacer in a shape similar to that of the spacer described in Patent Literature 1. This spacer includes gate remaining portions as material introduction portions in manufacturing, the gate remaining portions facing each other at a constricted portion (a coupling portion between adjacent ones of cylinder bores). Patent Literature 2 fails to describe, in detail, a runner (a hot runner) continuous to the gate remaining portions, the processing for such a runner, and the like. As is seen from the formation positions of the gate remaining portions, the runner couples between opposing constricted portions, and is removed after detachment of the spacer from a mold.

CITATION LIST

Patent Literature

PATENT LITERATURE 1: JP-A-2005-105878
PATENT LITERATURE 2: JP-A-2012-36742

SUMMARY OF THE INVENTION

Problem to be Solved by the Invention

In the case where the water jacket has the above-described structure, the shape of the narrow portion is different from those of other portions. Thus, portions of the spacer facing each other at the narrow portion are formed to have a constricted portion along the shape of the narrow portion of the water jacket. The bridge portion and runner as described above are preferably set to have the minimum length. In most cases, the bridge portion and runner are formed to couple between inner surfaces of the constricted portion. FIG. 11 schematically illustrates the positional relationship between a narrow portion 101*a* of a water jacket 101 and a spacer 102 inserted into the water jacket 101 (see FIG. 2 for the entire shape). In FIG. 11, the open deck water jacket 101 is formed to surround a plurality of cylinder bores (not shown) formed in series at a cylinder block 100. At the water jacket 101, the narrow portion 101*a* is formed corresponding to a coupling portion between adjacent ones of the cylinder bores (not shown). The width of the narrow portion 101*a* is greater than that of another flow path surrounding the cylinder bores. A remaining portion 102*c* formed due to a bridge portion and a runner (not shown) is formed on an inner peripheral surface of a constricted portion 102*a* of the spacer 102. The bridge portion and the runner are molded integrally with the spacer 102 in molding, and are removed after detachment of the spacer 102 from a mold. The remaining portion 102*c* protrudes toward a cylinder bore side inner wall 101*b* at the innermost part in the narrow portion 101*a*.

It is preferred that the remaining portion 102*c* is completely removed by finishing. However, such finishing requires great care and technique, and as a result, might contribute to discouragement of manufacturing efficiency improvement. In most cases, the spacer is used without finishing. In use, the spacer 102 is inserted into the water jacket 101. Thus, a great distance between the remaining portion 102*c* and the cylinder bore side inner wall 101*b* is maintained such that the remaining portion 102*c* is not brought into contact with the cylinder bore side inner wall 101*b*.

In the spacer described in Patent Literature 1, the bridge portion couples between opposing portions (inner surfaces) of a spacer body. Thus, the remaining portion formed after removal of the bridge portion protrudes from the inner surface toward a cylinder bore side inner wall. For this reason, the spacer described in Patent Literature 1 has the above-described problem. In addition, Patent Literature 1 fails to teach or suggest the method for solving such a problem. Moreover, according to Patent Literature 2, the gate remaining portion is formed as in Patent Literature 1. Thus, it is assumed that the same problem arises.

A spacer of the present invention has been made in view of the above-described problem. Of such a spacer, a protruding portion remaining after removal of a portion unnecessary after molding does not contact an inner wall of a coolant water flow path. Further, a portion of the spacer in the vicinity of the remaining portion can be positioned close to the cylinder bore side inner wall. The present invention is intended to provide such a spacer.

Solution to the Problems

A spacer of the present invention is a spacer formed of a resin molded body and used by being inserted into a coolant water flow path through an opening of the coolant water flow path, the coolant water flow path being formed around a plurality of cylinder bores formed adjacent to each other in a cylinder block of an internal combustion engine. The spacer includes: a spacer body formed in a cylindrical shape to surround the plurality of cylinder bores; and a protruding remaining portion remaining after removal of a portion necessary in molding and unnecessary after the molding. The remaining portion is formed at an end surface of the spacer body positioned on a side close to the opening.

According to the spacer of the present invention, when the spacer is inserted into the coolant water flow path, contact between the remaining portion and a cylinder bore side inner wall of the coolant water flow path is reduced. Thus, even a portion of the spacer in the vicinity of the remaining portion can be positioned close to the cylinder bore side inner wall.

The spacer of the present invention may include a stemming portion formed on an inner peripheral portion of the spacer body and extending to intersect a flow direction of coolant water in the coolant water flow path and to include the end surface of the spacer body. The remaining portion may be formed at a position on a protrusion side of the end surface of the stemming portion.

With the stemming portion, the flow of coolant water is stemmed so that such a coolant water flow can be controlled. However, when the remaining portion is formed at the end portion on the protruding side of the stemming portion, the amount of protrusion of the stemming portion is limited. In other words, there is a disadvantage that the amount of protrusion of the stemming portion decreases by the amount of protrusion of the remaining portion. In contrast, in the present invention, the stemming portion can protrude closer to the cylinder bore side inner wall. Thus, a higher stemming effect can be exhibited by the stemming portion.

In the spacer of the present invention, the spacer body may include a plurality of arc portions formed along an outer shape of each cylinder bore, and a connection portion connecting adjacent ones of the arc portions. The stemming portion may be provided on an inner peripheral portion of the connection portion.

With this configuration, coolant water circulating in the vicinity of the region between adjacent ones of the cylinder bores can be regulated by the stemming portion. Thus, overcooling of the region between adjacent ones of the cylinder bores is prevented. This can suppress a decrease in the roundness of the cylinder bore wall.

In the spacer of the present invention, the remaining portion may include a pair of remaining portions formed to sandwich the cylinder bore, the unnecessary portion may be a crossing portion coupling between the opposing end surfaces of the spacer body in the molding, and portions of the end surfaces provided with the pair of remaining portions may be formed to incline inward toward each other.

With this configuration, the spacer body is reinforced by the crossing portion until the crossing portion is removed. This prevents deformation such as distortion due to cooling of the molded body. In addition, the above-described end surface inclines inward. Thus, the length of the crossing portion is not so long. This increases the rigidity of the crossing portion. Consequently, until the crossing portion is removed, lowering of the accuracy of dimensions of the spacer body can be effectively avoided.

In the spacer of the present invention, the remaining portion may include a pair of remaining portions formed to sandwich the cylinder bore, the unnecessary portion may be a crossing portion coupling between the opposing end surfaces of the spacer body in the molding, and portions of the end surfaces provided with the pair of remaining portions may be formed parallel to the opening of the coolant water flow path.

With this configuration, the pair of remaining portions formed at the above-described end surfaces are formed in such a manner that the crossing portion crossing between the end surfaces are removed. Thus, the spacer body is reinforced by the crossing portion until the crossing portion is removed. This prevents deformation such as distortion. In addition, a portion on the end surface provided with the remaining portion is formed parallel to the opening of the coolant water flow path. Thus, the remaining portion reliably protrudes toward the opening. Consequently, the spacer body can be positioned closer to the inner wall regardless of the amount of protrusion of the remaining portion.

In the spacer of the present invention, the end surface provided with the remaining portion may form a flat seating surface wider than the remaining portion.

With this configuration, when the unnecessary portion is removed by a cutting tool or the like, the unnecessary portion can be cut and removed in the state in which the cutting tool is in contact with and is positioned on the seating surface. This prevents variation in the amount of protrusion of the remaining portion.

In the spacer of the present invention, the remaining portion may be formed to protrude perpendicular to the end surface.

With this configuration, further protrusion of the remaining portion toward the cylinder bore is suppressed. Thus, the probability of the remaining portion contacting the cylinder bore side inner wall can be further reduced.

Effects of the Invention

According to the spacer of the present invention, the protruding portion remaining after removal of the portion unnecessary after molding is not brought into contact with the inner wall of the coolant water flow path. Thus, even the portion in the vicinity of the remaining portion can be positioned close to the cylinder bore side inner wall.

DESCRIPTION OF EMBODIMENTS

Embodiments of the present invention will be described below with reference to FIGS. 1 to 10. FIGS. 1 to 6 illustrate a spacer according to the embodiment of the present invention. FIG. 2 illustrates a state in which the spacer of the present embodiment is inserted into a water jacket of a cylinder block of an internal combustion engine.

Figure 1:
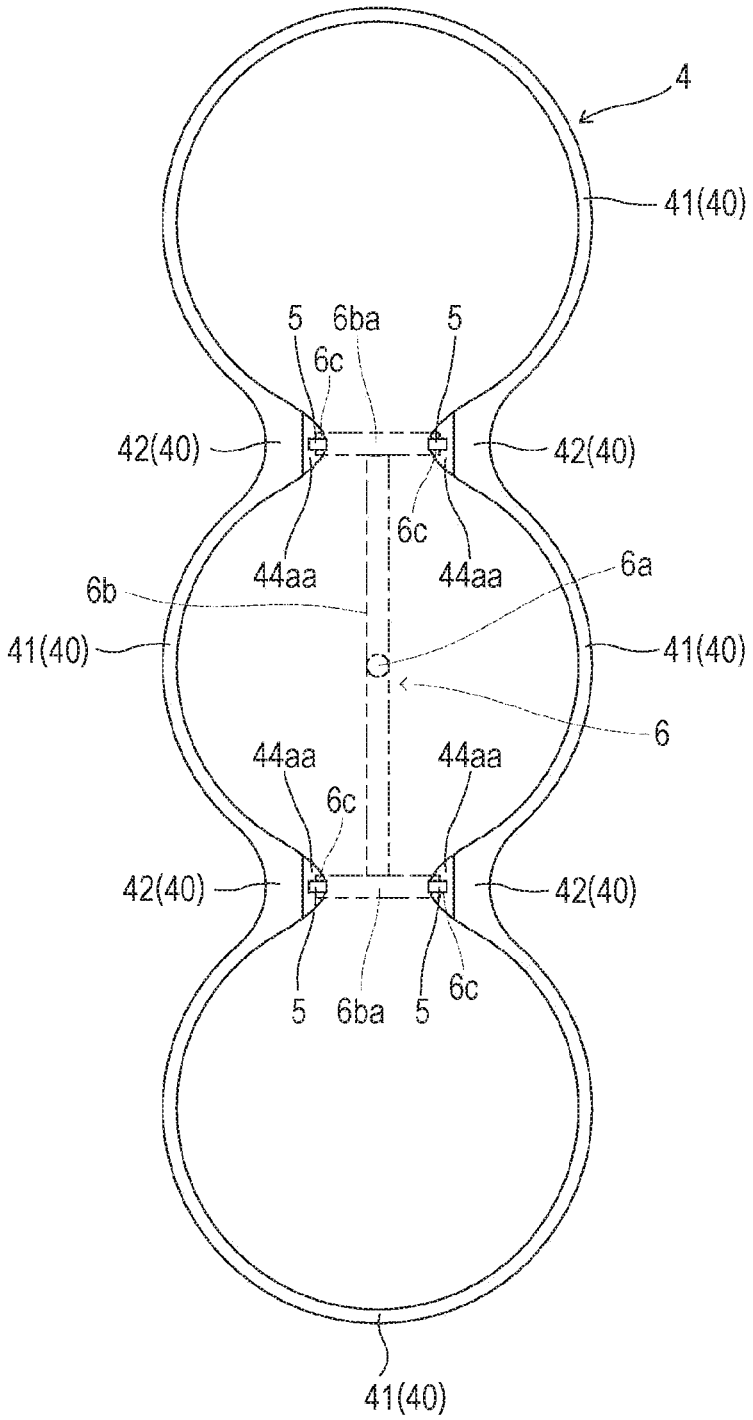
FIG. 1 is a schematic plan view of a spacer according to an embodiment of the present invention.
Figure 2:
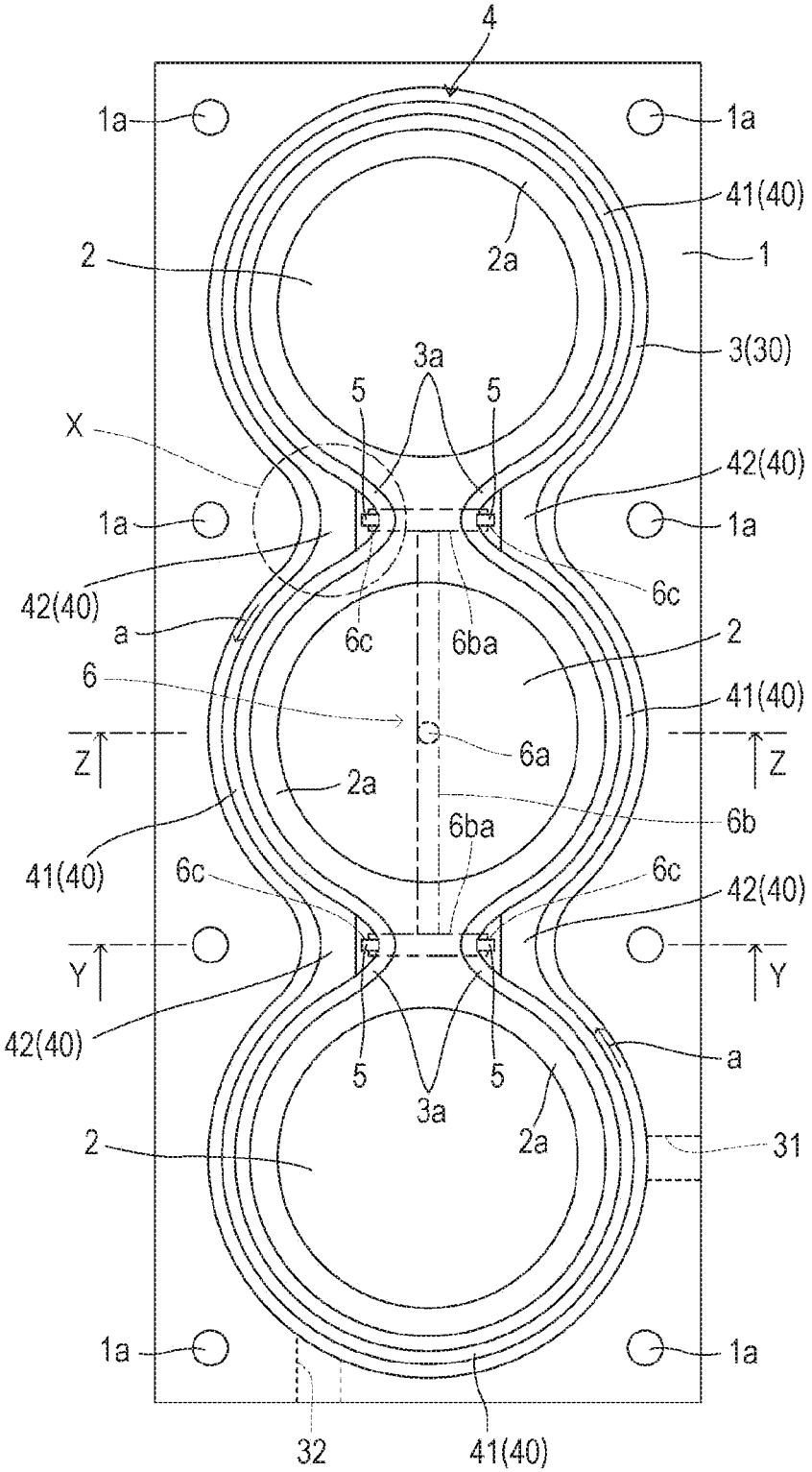
FIG. 2 is a schematic plan view of the state in which the spacer is inserted into a water jacket of a cylinder block of an internal combustion engine.

As illustrated in FIG. 1, a spacer 4 of the present embodiment includes a cylindrical spacer body 40 formed of a resin molded body. The spacer body 40 includes a plurality of arc portions 41, adjacent ones of which are arranged in series, and connection portions 42 each connecting adjacent ones of the arc portions 41 and having a narrower width than that of the arc portion 41. The connection portion 42 has a constricted shape. In the example of the figure, the connection portions 42 are formed at four positions. The spacer 4 of the present embodiment is, as illustrated in FIG. 2, inserted into a water jacket (a coolant water flow path) 3 of a cylinder block 1. The cylinder block 1 forms a three-cylinder engine (an internal combustion engine). The cylinder block 1 is provided with three adjacent cylinder bores 2 arranged in series. The water jacket 3 in a recessed groove shape is continuously formed to surround bore walls 2*a* of these three cylinder bores 2. A not-shown cylinder head is, with bolts (not shown), integrally fastened to an upper end surface of the cylinder block 1. A reference numeral "1*a*" denotes a bolt insertion hole. The cylinder block 1 and the cylinder head are integrally fastened together in such a manner that the bolts are inserted respectively into the bolt insertion holes 1*a*.

A pair of narrow portions 3*a* positioned close to each other is formed between adjacent ones of the cylinder bores 2 in the water jacket 3. The groove width of the narrow portion 3*a* is set greater than those of other portions of the water jacket 3. The water jacket 3 in the example of the figure is an open deck water jacket provided with an opening 30 (see FIGS. 5 to 8 and FIG. 10) at the surface close to the not-shown cylinder head. At the cylinder block 1, a water supply hole 31 communicating from the outside of the cylinder block 1 to the water jacket 3 is formed. Moreover, a drain hole 32 communicating from the water jacket 3 to the outside is formed close to the water supply hole 31 at the cylinder block 1. Coolant water supplied through the water supply hole 31 circulates in the water jacket 3 substantially in the direction of an arrow a. The water jacket 3 is configured such that coolant water is discharged to the outside (a radiator) of the cylinder block 1 through the drain hole 32.

Note that in the case where the water jacket 3 is configured such that coolant water also circulates from the cylinder block 1 to a water jacket (not shown) of the cylinder head, a coolant water communication portion (not shown) is, instead of the drain hole 32, provided at a joint portion between the cylinder block 1 and the cylinder head. Thus, coolant water flows between the water jackets. In this case, a drain hole communicating with the radiator is formed at the water jacket (not shown) of the cylinder head.

Figure 3:
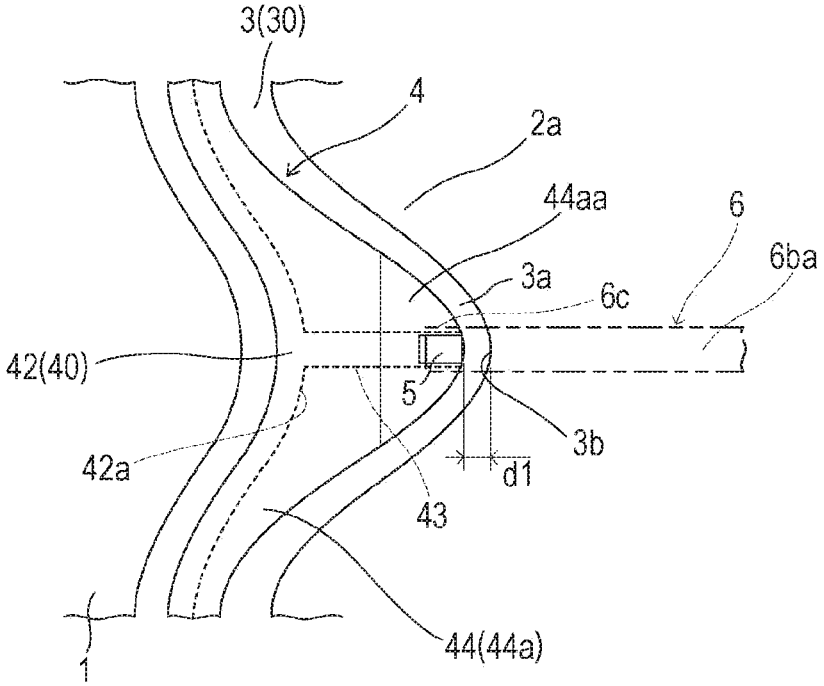
FIG. 3 is an enlarged view of a portion X of FIG. 2.

The spacer body 40 of the spacer 4 of the present embodiment is formed to surround the cylinder bores 2 (in the example of the figure, three cylinder bores 2) when the spacer body 40 is inserted into the water jacket 3. That is, each arc portion 41 is formed in accordance with the outer shape of the cylinder bore 2. The connection portion 42 fits the narrow portion 3*a* of the water jacket 3. At each of the inner peripheral portion 42*a* of the connection portions 42 facing each other, a stemming portion 43 is provided to extend toward a cylinder bore side inner wall 3*b* at the innermost part of the narrow portion 3*a* as illustrated in FIG. 3. The stemming portions 43 are formed in pair to sandwich the cylinder bore 2 (a portion between adjacent ones of the cylinder bores 2). In the example of the figure, two pairs of stemming portions 43 (i.e., four stemming portions 43) are formed. Each stemming portion 43 is formed in a plate shape continuous along the axial direction of the spacer body 40, and is formed to intersect with the coolant water flow direction a in the water jacket 3. More specifically, the stemming portion 43 extends substantially perpendicular to the inner peripheral portion 42*a* of the connection portion 42. The stemming portion 43 regulates coolant water circulating in the vicinity of the region between adjacent ones of the cylinder bores 2, i.e., circulating through the narrow portions 3*a*. This prevents overcooling of the region between adjacent ones of the cylinder bores 2. As a result, the roundness of the cylinder bore wall 2*a* (i.e., the outer diameter of the cylinder bore 2) is difficult to be lower.

Moreover, the spacer body 40 includes, across the entire periphery thereof, a flange portion 44 protruding toward the cylinder bore side inner wall 3*b* at an upper end portion (an end portion positioned close to the opening 30 of the water jacket 3) of the spacer body 40. When the spacer 4 is inserted into the water jacket 3, the flange portion 44 is positioned close to the opening 30. An upper surface of the flange portion 44 is hereinafter referred to as an opening-side end surface 44*a* of the spacer body 40. The flange portion 44 extends over an upper end of the stemming portion 43. In the present embodiment, the opening-side end surface 44*a* on each stemming portion 43 is provided with a seating surface 44*aa* inclining inward. Note that in the present embodiment, inward inclination of the seating surface 44*aa* means that the seating surface 44*aa* downwardly extends toward the inner side. The seating surface 44*aa* is positioned on a protrusion side of the stemming portion 43, and is formed flat. The seating surface 44*aa* is provided with a vertically-protruding remaining portion 5. The seating surface 44*aa* is formed flat to have a wider plane area than that of the remaining portion 5.

Note that a lower end portion of the spacer body 40 is positioned opposite to the opening 30 of the water jacket 3, i.e., positioned on a bottom side of the water jacket 3. A lower surface at such a lower end portion is an end surface different from the above-described end surface.

The stemming portion 43 in the example of the figure is formed of a plate body having a band-shaped cross section. However, the present invention is not limited thereto, and the stemming portion 43 may have a cross-sectional shape similar to that of the flange portion 44 positioned on the upper end of the stemming portion 43.

The remaining portion 5 is a portion necessary in resin molding of the spacer 4 and remaining after removal of a portion 6 unnecessary after molding. The unnecessary portion 6 in the present embodiment is indicated by two-dot chain lines in FIGS. 1 to 6. The unnecessary portion 6 corresponds to a portion including a sprue 6*a*, a runner 6*b*, and gates 6*c* in injection molding using resin. The unnecessary portion 6 includes a crossing portion 6*ba* (part of the runner 6*b*) coupling between the end surfaces 44*a* (the seating surfaces 44*aa*) of the spacer body on the pair of stemming portions 43 facing each other. The crossing portion 6*ba* is formed to bridge over the seating surfaces 44*aa* on the stemming portions 43 facing each other. The unnecessary portion 6 is removed after molding of the spacer body 40. The portion 6 is cut and removed in the state in which a cutting tool such as a nipper is in contact with and is positioned on the seating surface 44*aa*. This reduces variation in the amount of protrusion of the remaining portion 5 formed after the above-described cutting.

As described above, the unnecessary portion 6 including the crossing portion 6*ba* is removed after molding of the spacer 4 and before insertion into the water jacket 3. Note that the portion 6 reinforces the spacer body 40 until the portion 6 is removed. In particular, the spacer body 40 is formed by injection molding under high temperature. The shape of the spacer body 40 is retained in such a manner that the spacer body 40 is gradually cooled to normal temperature after detachment from a mold. In gradually cooling, the spacer body 40 tends to deform due to heat contraction imbalance because of an elongated circular cylindrical shape of the spacer body 40. Moreover, in the process of detachment from the mold, mechanical stress is applied onto the spacer body 40. However, the unnecessary portion 6 prevents thermal distortion and deformation due to mechanical stress and the like. The crossing portion 6*ba* couples the shortest part between the end surfaces 44*a* of the spacer body on the stemming portions 43 facing each other. Thus, the reinforcement function is more effectively exhibited. In addition, the opposing end surfaces 44*a* (the seating surfaces 44*aa*) of the spacer body 40 incline inward toward each other. This further shortens the crossing portion 6*ba*. As a result, the rigidity of the crossing portion 6*ba* is enhanced. Consequently, lowering of the dimension accuracy of the spacer body 40 can be more effectively suppressed until the unnecessary portion 6 including the crossing portions 6*ba* is removed.

Figure 11:
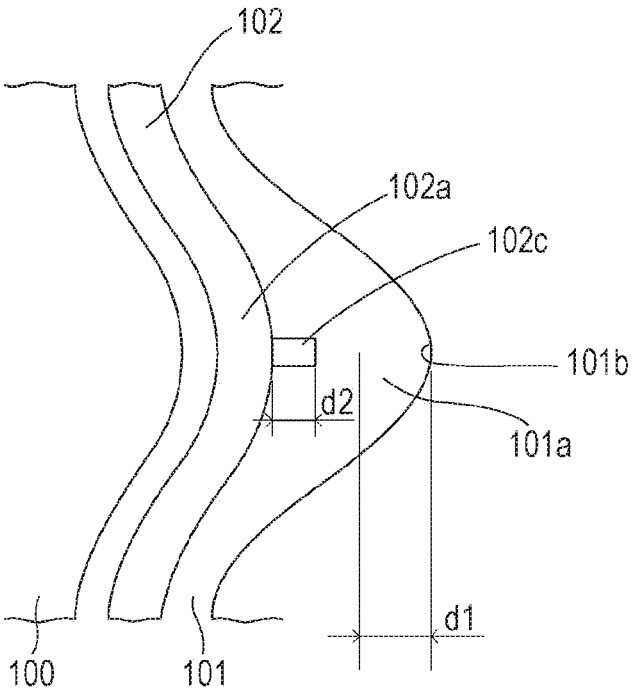
FIG. 11 is a view of a typical spacer, and corresponds to FIG. 3.

The remaining portion 5 is formed at the end surface 44*a* (the seating surface 44*aa*) of the spacer body 40 on the stemming portion 43. The protrusion amount T of the connection portion 42 from the inner peripheral portion 42*a* is reduced. Thus, when the spacer 4 is inserted into the water jacket 3, the remaining portion 5 is difficult to contact the innermost part of the cylinder bore side inner wall 3*b*. Consequently, as is clearly seen from comparison between a distance d1 illustrated in FIG. 3 and a distance d1 illustrated in FIG. 11, the protrusion end of the stemming portion 43 is positioned as close to the cylinder bore side inner wall 3*b* as possible. This effectively exhibits the function of stemming and regulating coolant water by the stemming portion 43.

Figure 4:
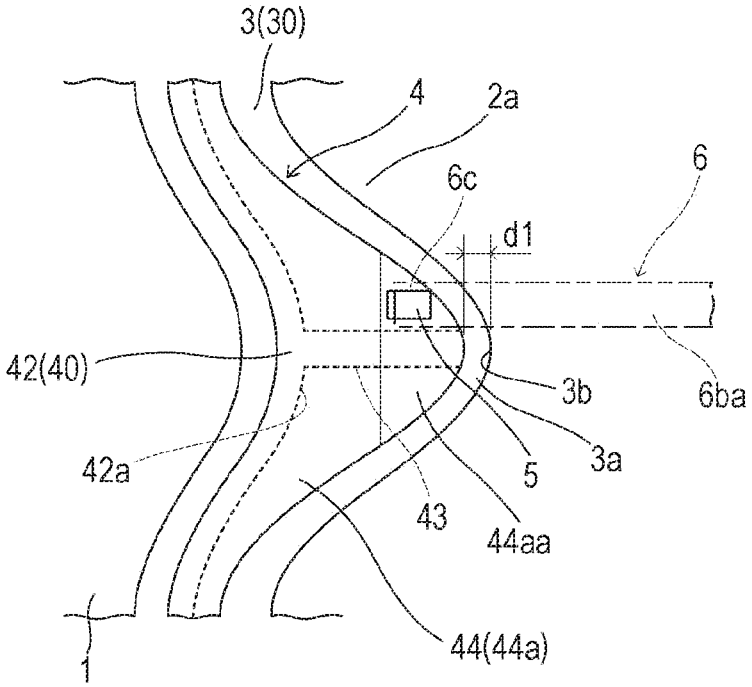
FIG. 4 is a view of a variation of the embodiment, and corresponds to FIG. 3.

FIG. 4 illustrates a variation of the present embodiment. In the example of FIG. 3, the remaining portion 5 is formed right above the stemming portion 43. However, in this case, the remaining portion 5 is, on the seating surface 44*aa* of the end surface 44*a* of the spacer body 40 similarly to the above-described example, formed at such a position that the remaining portion 5 is shifted to one side in the thickness direction of the stemming portion 43 on a tip end side of the stemming portion 43 in the protrusion direction thereof. Since the length of the crossing portion 6*ba* becomes longer than that of the above-described example, the reinforcement function of the unnecessary portion 6 including the crossing portions 6*ba* is slightly lowered as compared to the above-described example. However, the remaining portion 5 is still difficult to contact the innermost part of the cylinder bore side inner wall 3*b*. Thus, similar features and advantageous effects to those in the above-described example are provided.

Since other configurations are similar to those in the above-described example, the same reference numerals are used to represent equivalent elements and description thereof is omitted.

Figure 7:
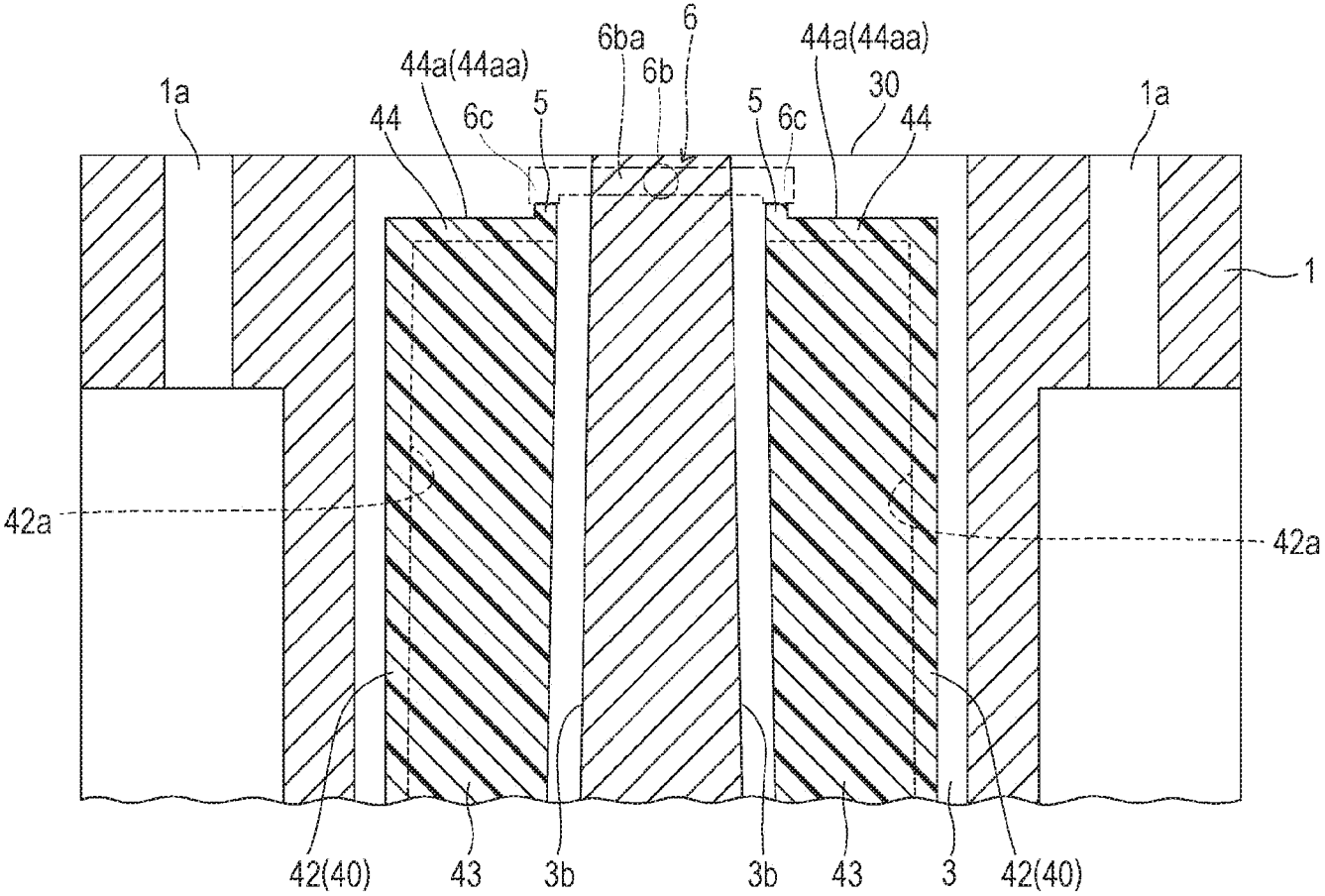
FIG. 7 is a view of a spacer according to another embodiment of the present invention, and corresponds to FIG. 5.

FIG. 7 illustrates a spacer of another embodiment of the present invention. In the present embodiment, a seating surface 44*aa* forming part of an end surface 44*a* of a spacer body 40 is formed parallel to an opening 30 of a water jacket 3. That is, the end surface 44*a* of the spacer body 40 including the seating surface 44*aa* is flat. The entirety of such an end surface 44*a* of the spacer body 40 is formed parallel to the opening 30 of the water jacket 3. Unlike the above-described example, the seating surface 44*aa* does not incline. The remaining portion 5 is formed to vertically protrude on the seating surface 44*aa*. In the present embodiment, a pair of stemming portions 43 facing each other extends from inner peripheral portions 42*a* of connection portions 42 of the spacer body 40 toward cylinder bore side inner walls 3*b*. Each seating surface 44*aa* on the stemming portions 43 is provided with the remaining portion 5. The remaining portion 5 is formed on the seating surface 44*aa* parallel to the opening 30 of the water jacket 3 as described above. Thus, the probability of the remaining portion 5 contacting the cylinder bore side inner wall 3*b* can be further reduced. In other words, the remaining portion 5 does not protrude inward relative to the inner peripheral portion 42*a* of the connection portion 42. Thus, the stemming portion 43 can be positioned closer to the cylinder bore side inner wall 3*b* regardless of the amount of protrusion of the remaining portion 5.

Since other configurations, features, and advantageous effects are similar to those in the above-described example, the same reference numerals are used to represent equivalent elements and description thereof is omitted.

Figure 8:
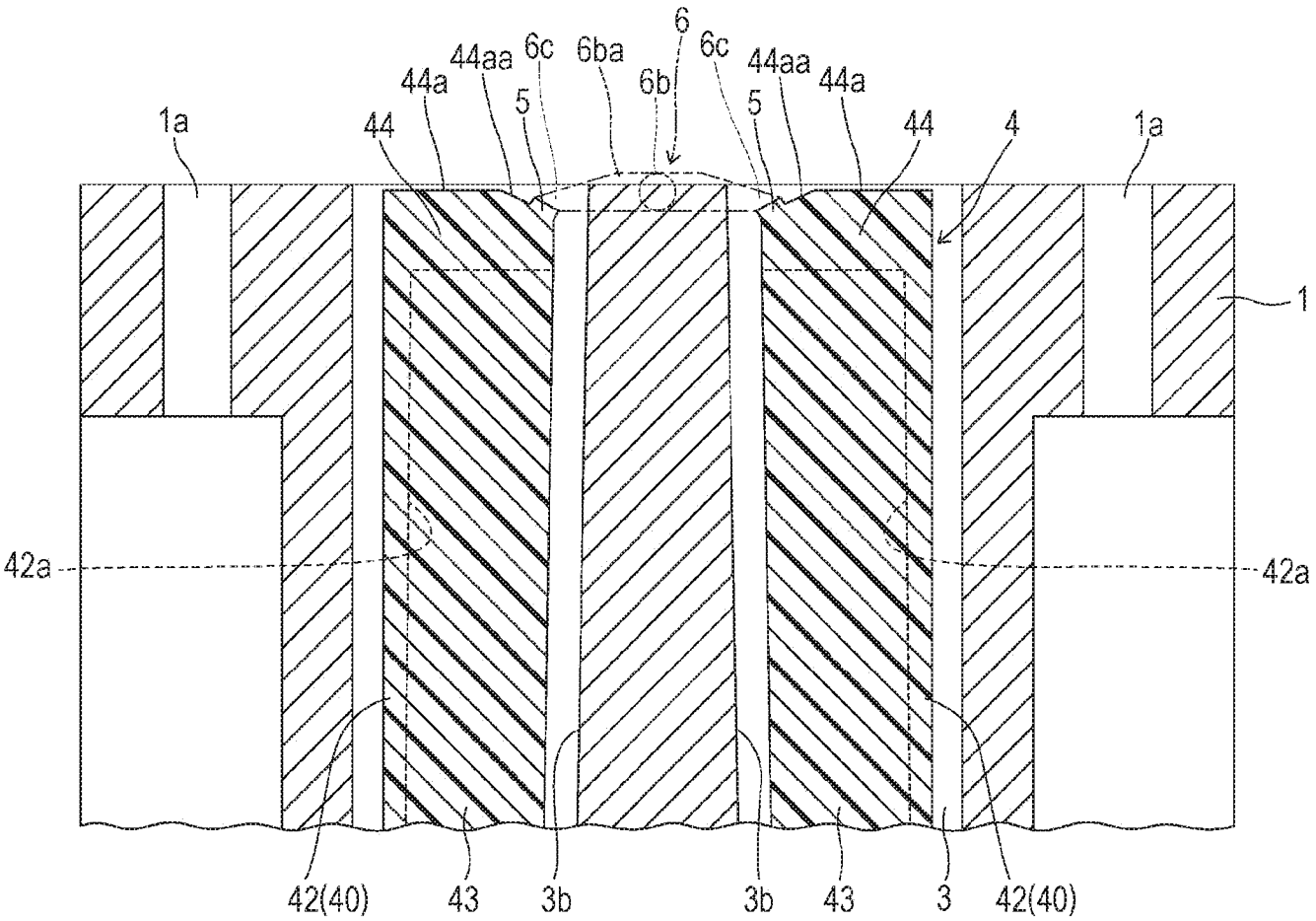
FIG. 8 is a view of a variation common to the embodiments, and corresponds to FIG. 5.

FIG. 8 illustrates another variation having the common features to the above-described embodiment. FIG. 8 corresponds to FIG. 5. When the spacer 4 of the above-described example is inserted into the water jacket 3, the opening-side end surface 44*a* of the spacer body 40 is positioned lower than the opening 30 of the water jacket 3. However, in the present embodiment, the spacer having the upper end portion extending toward the opening 30 will be described. The opening-side end surface 44*a* of the spacer body 40 is formed in the vicinity of the opening 30. As in the above-described embodiment, the spacer body 40 has the flange portion 44. The thickness of the flange portion 44 is greater in the present embodiment than that in the above-described example. The volume of a portion of the spacer 4 embedded in the water jacket 3 in the present embodiment becomes substantially greater. Thus, the flow rate of coolant water circulating in the water jacket 3 is different from that in the above-described example. However, these can be optionally selected and employed according to a desired cooling function. In the region, including the flange portion 44, of the water jacket 3 in the depth direction thereof, the flow path between the flange portion 44 and the narrow portion 3*a* is narrow. This increases the flow velocity of coolant water. On the other hand, in the region, including the stemming portions 43, of the water jacket 3 in the depth direction thereof, the flow of coolant water is stemmed by the stemming portions 43. This weakens the flow of coolant water. Thus, heat tends to accumulate between adjacent ones of the cylinder bores on the side close to the opening 30. With the spacer 4 of the present embodiment, a portion between adjacent ones of the cylinder bores in the region including the flange portions 44 is actively cooled in operation of the internal combustion engine. Meanwhile, overcooling of the portion between adjacent ones of the cylinder bores in the region including the stemming portions 43 can be prevented. Note that the embodiment where the opening-side end surfaces 44*a* are positioned in vicinity of the opening 30 as described above is also applicable to the example illustrated in FIG. 7.

Figure 5:
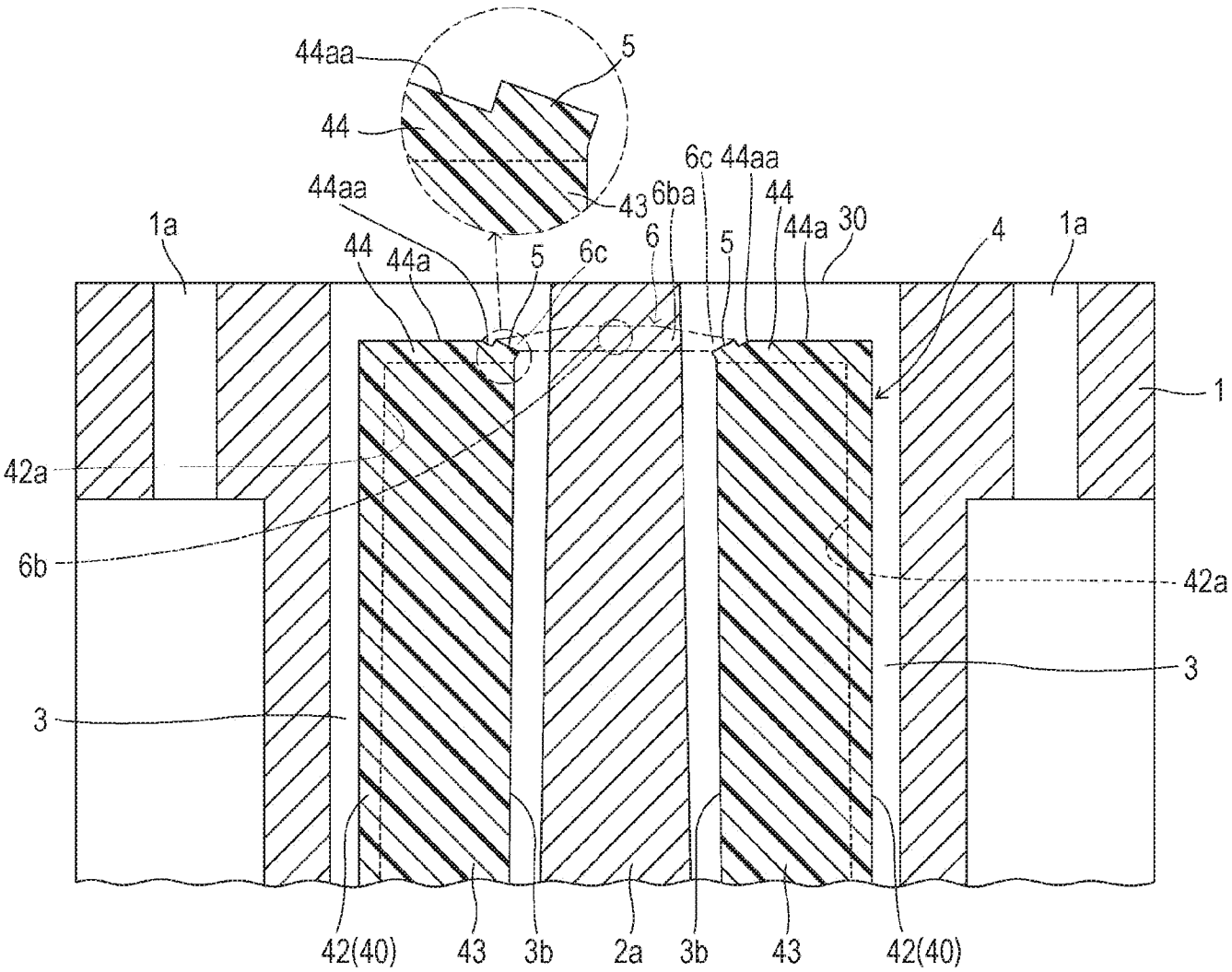
FIG. 5 is an enlarged cross-sectional view taken along a Y-Y line of FIG. 2.

Since other configurations, features, and advantageous effects are similar to those in the example illustrated in FIG. 5, the same reference numerals are used to represent equivalent elements, and description thereof is omitted.

Figure 9:
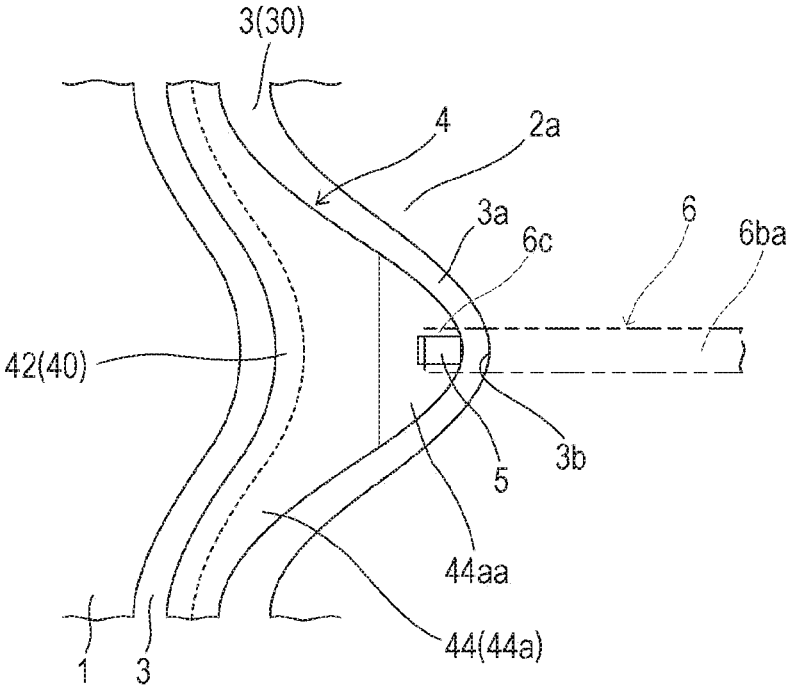
FIG. 9 is a view of a spacer according to still another embodiment of the present invention, and corresponds to FIG. 3.
Figure 10:
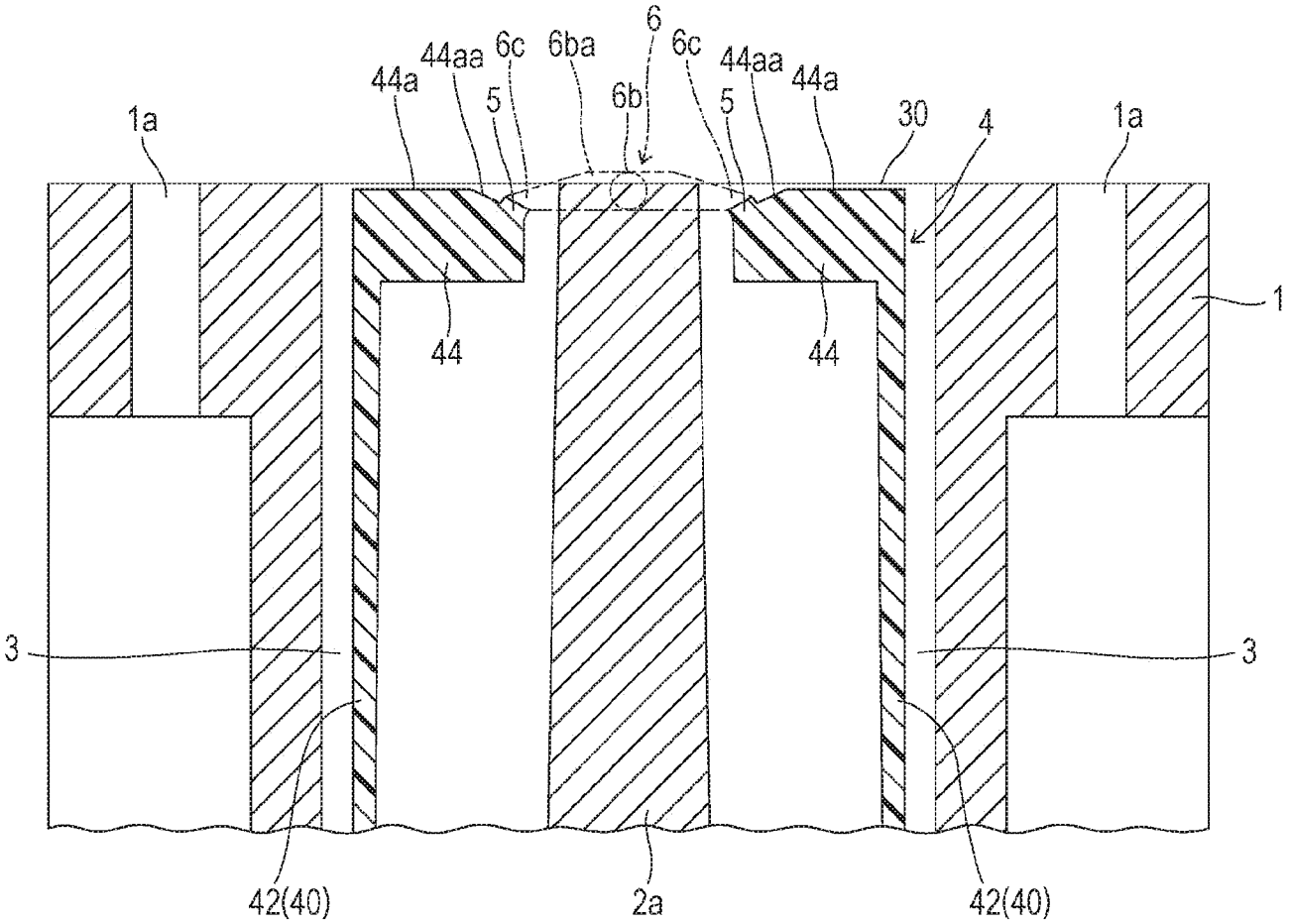
FIG. 10 is a view of the still another embodiment, and corresponds to FIG. 5.

FIGS. 9 and 10 illustrate a spacer according to still another embodiment of the present invention. In this embodiment, a spacer 4 includes no stemming portion 43 described in the above-described embodiments. Even if the spacer 4 includes the stemming portions 43, stemming portions 43 are not formed at narrow portions 3*a*. These figures illustrate the examples where the remaining portion 5 is formed at a position other than the formation position of the stemming portion 43. No stemming portion 43 is formed at a connection portion 42 of a spacer body 40. A flange portion 44 similar to that in the example illustrated in FIG. 8 is formed at an upper end portion of the spacer body 40. The flange portion 44 of the connection portion 42 of the spacer body 40 is in a shape facing the vicinity of a cylinder bore side inner wall 3*b*. As in the above-described embodiments, an upper surface of each flange portion 44 forms an end surface 44*a* of the spacer body. A seating surface 44*aa* inclining inward is formed at a tip end of such an upper surface facing the innermost cylinder bore side inner wall 3*b* described above. At such a seating surface 44*aa*, the remaining portion 5 similar to those of the above-described embodiments is formed to protrude vertically. As illustrated in FIG. 10, the remaining portion 5 is a member remaining after removal of a crossing portion 6*ba*. The crossing portion 6*ba* is formed to couple the seating surfaces 44*aa* by a runner 6*b*. The runner 6*b* is positioned to bridge over the opposing seating surfaces 44*aa* in resin molding of the spacer body.

Each remaining portion 5 of the spacer 4 of the present embodiment is also formed not to protrude toward the cylinder bore side inner wall 3*b*. Thus, when the spacer 4 is inserted into a water jacket 3, the remaining portions 5 do not contact the cylinder bore side inner walls 3*b*. Thus, the spacer body 40 can be positioned as close to the cylinder bore side inner walls 3*b* as possible.

Figure 6:
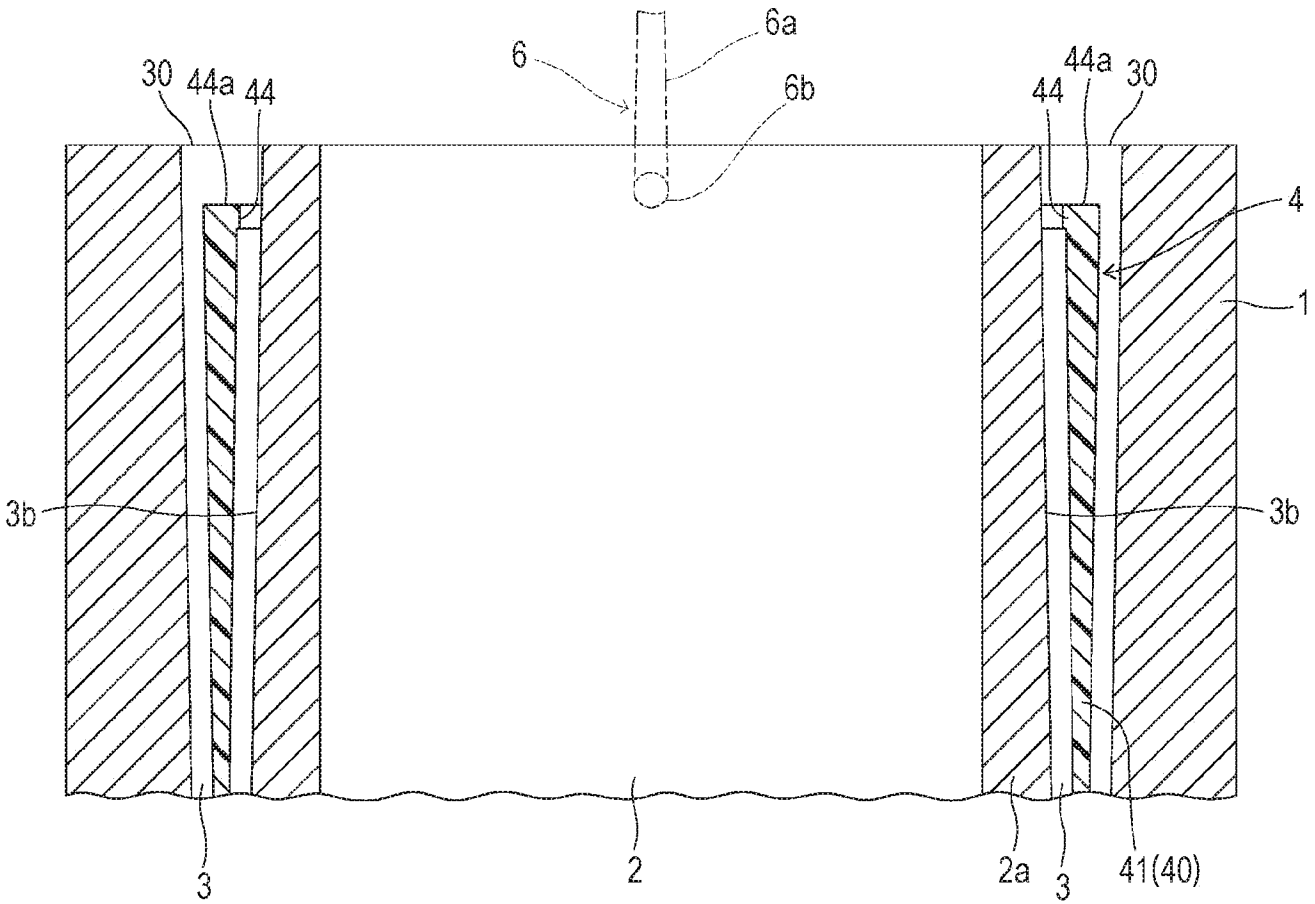
FIG. 6 is an enlarged cross-sectional view taken along a Z-Z line of FIG. 2.

In the present embodiment, the end surfaces 44*a* of the spacer body 40 are, as in FIG. 8, formed in the vicinity of the opening 30 of the water jacket 3. Note that as illustrated in FIGS. 5 to 7, the end surface 44*a* of the spacer body 40 may be formed lower than the opening 30. Moreover, in this example, the seating surface 44*aa* inclines inward. Note that the end surfaces 44*a* may be, as in the example of FIG. 7, formed parallel to the opening 30 of the water jacket 3.

Since other configurations, features, and advantageous effects are similar to those in the example illustrated in FIG. 8, the same reference numerals are used to represent equivalent elements, and description thereof is omitted.

In each embodiment described above, the remaining portion 5 is a portion remaining after removal of the crossing portions 6*ba* of the runner 6*b* for resin injection. Note that the remaining portion 5 may be a portion remaining after removal of a similar crossing portion formed separately from the runner 6*b* etc. In this case, the crossing portion is positioned as illustrated in the figure. The sprue 6*a*, the runner 6*b*, and the gate 6*c* are preferably formed at other positions. For example, the gate 6*c* may be formed at one or more positions corresponding to the outer portion of the spacer body 40. The spacer body 40 and the crossing portion may be integrally molded by resin injection through such a gate 6*c*. Moreover, the crossing portion 6*ba* is formed to bridge over each pair of connection portions. Note that the crossing portion 6*ba* may be formed to bridge over any one of the pairs of connection portions.

Moreover, the remaining portion 5 is not limited to a portion remaining after removal of the crossing portions 6*ba* formed at the same time as resin molding of the spacer body 40. For example, in the case where sprues 6*a* are formed respectively for gates 6*c* or the case where a single gate 6*c* is formed, an unnecessary portion 6 including the sprue(s) 6*a*, the runner 6*b*, and the gate(s) 6*c* does not cross between seating surfaces 44*aa*. Thus, the portion 6 includes no crossing portion 6*ba*.

Further, the planar shape of the remaining portion 5 is not limited to the rectangular shape as in the example of the figure. Such a planar shape may be a rectangular shape with R-corners, a circular shape, an oval shape, or an elongated circular shape. The side shape of the remaining portion 5 is not limited to the rectangular shape as illustrated in the enlarged portion of FIG. 5. Such a side shape may be an inwardly-inclining parallelogram other than a rectangle. These planar and side shapes of the remaining portion 5 are determined according to the shapes of the sprue 6*a*, the runner 6*b*, and the gate 6*c* optimized in designing.

In addition, the example where the spacer body 40 includes the flange portions 44 at the upper end thereof has been described. However, the spacer body including no flange portion is not excluded. Moreover, the shape of the spacer body 40 and the shape and thickness of the flange portion 44 are not limited to those shown in the figures, for example. In the present embodiment, the spacer applied to the water jacket in the three-cylinder internal combustion engine has been described. Needless to say, the spacer of the present invention is also applicable to a spacer for water jacket with a different number of cylinders. The cylinder block 1 of FIG. 2 is merely schematically illustrated. Thus, the entire shape of the cylinder block 1 is not limited to that in the example of the figure.

LIST OF NUMERAL REFERENCES

1 Cylinder block
2 Cylinder bore
3 Water jacket (coolant water flow path)
30 Opening
4 Spacer
40 Spacer body
41 Arc portion
41 Connection portion
42*a* Inner peripheral portion of connection portion
43 Stemming portion
44*a* End surface of spacer body
44*aa* Seating surface
5 Remaining portion
6 Unnecessary portion
6*ba* Crossing portion (part of molded portion by runner)

The invention claimed is:

1. A spacer formed of a resin molded body and used by being inserted into a coolant water flow path through an opening of the coolant water flow path, the coolant water flow path being formed around a plurality of cylinder bores formed adjacent to each other in a cylinder block of an internal combustion engine, comprising:

a spacer body formed in a cylindrical shape to surround the plurality of cylinder bores; and a protruding remaining portion remaining after removal of a portion necessary in molding and unnecessary after the molding, wherein the spacer body comprises:

a stemming portion being formed on an inner peripheral portion of the spacer body, extending to intersect a flow direction of coolant water in the coolant water flow path and having an uppermost surface in an axial direction of the spacer body; and at an upper end of the spacer body positioned on a side close to the opening, a flange portion protruding from an inner peripheral wall of the spacer body toward a bore wall of the cylinder bores and extending over the uppermost surface of the stemming portion, the remaining portion is formed at an uppermost surface of the flange portion in the axial direction, and the remaining portion and the stemming portion are arranged in this order from upper to lower in the axial direction.

2. The spacer according to claim 1, wherein the spacer body includes a plurality of arc portions formed along an outer shape of each cylinder bore, and a connection portion connecting adjacent ones of the arc portions, and the stemming portion is provided on an inner peripheral portion of the connection portion.

3. The spacer according to claim 2, wherein the remaining portion includes a pair of remaining portions formed to sandwich the cylinder bore, the unnecessary portion is a crossing portion coupling between the opposing end surfaces of the spacer body in the molding, and portions of the uppermost surfaces provided with the pair of remaining portions are formed to incline inward toward each other.

4. The spacer according to claim 2, wherein the remaining portion includes a pair of remaining portions formed to sandwich the cylinder bore, the unnecessary portion is a crossing portion coupling between the opposing end surfaces of the spacer body in the molding, and portions of the uppermost surfaces provided with the pair of remaining portions are formed parallel to the opening of the coolant water flow path.

5. The spacer according to claim 2, wherein the uppermost surface provided with the remaining portion forms a flat seating surface wider than the remaining portion.

6. The spacer according to claim 2, wherein the remaining portion is formed to protrude from the uppermost surface of the flange portion in a direction perpendicular to the uppermost surface of the flange portion.

7. The spacer according to claim 1, wherein the remaining portion includes a pair of remaining portions formed to sandwich the cylinder bore, the unnecessary portion is a crossing portion coupling between the opposing end surfaces of the spacer body in the molding, and portions of the uppermost surfaces provided with the pair of remaining portions are formed to incline inward toward each other.

8. The spacer according to claim 1, wherein the remaining portion includes a pair of remaining portions formed to sandwich the cylinder bore, the unnecessary portion is a crossing portion coupling between the opposing end surfaces of the spacer body in the molding, and portions of the uppermost surfaces provided with the pair of remaining portions are formed parallel to the opening of the coolant water flow path.

9. The spacer according to claim 1, wherein the uppermost surface provided with the remaining portion forms a flat seating surface wider than the remaining portion.

10. The spacer according to claim 1, wherein the remaining portion is formed to protrude from the uppermost surface of the flange portion in a direction perpendicular to the uppermost surface of the flange portion.

11. The spacer according to claim 1, wherein a thickness of the stemming portion being larger than a thickness of the inner peripheral wall in a direction toward the bore wall of the cylinder bores.

12. The spacer according to claim 11, wherein the remaining portion is formed right above the stemming portion.

13. The spacer according to claim 11, wherein the flange portion is located closer to the opening in the axial direction than the stemming portion is.

14. The spacer according to claim 1, wherein a bottom surface of the flange portion is connected to the uppermost surface of the stemming portion.

15. The spacer according to claim 1, wherein a bottom surface of the flange portion is in direct contact with the uppermost surface of the stemming portion.

* * * * *